US005509476A

United States Patent [19]

Vick, Jr.

[11] Patent Number: 5,509,476

[45] Date of Patent: Apr. 23, 1996

[54] SHORT WELLHEAD PLUG

[75] Inventor: James D. Vick, Jr., Dallas, Tex.

[73] Assignee: Halliburton Company, Houston, Tex.

[21] Appl. No.: 207,000

[22] Filed: Mar. 7, 1994

[51] Int. Cl.[6] ..... E21B 33/03

[52] U.S. Cl. ..... 166/75.13; 138/89; 166/115; 166/135

[58] Field of Search ..... 166/115, 125, 166/217, 88, 192, 97, 92, 93, 75.13, 135; 138/89

[56] References Cited

U.S. PATENT DOCUMENTS

| | | | |
|---|---|---|---|
| 1,822,444 | 9/1931 | MacClatchie | 166/217 X |
| 3,155,116 | 11/1964 | Ver Nooy | 138/89 |
| 3,250,331 | 5/1966 | Boyle | 166/217 X |
| 3,288,222 | 11/1966 | Urbanosky | 166/192 |
| 3,457,992 | 7/1969 | Brown | 166/88 X |
| 3,646,996 | 3/1972 | Pearce, Jr. | 166/212 |
| 4,121,660 | 10/1978 | Koleilat | 166/135 |
| 4,164,977 | 8/1979 | Arendt et al. | 166/125 |
| 4,362,211 | 12/1982 | Fisher, Jr. | 166/217 |
| 4,396,061 | 8/1983 | Tamplen et al. | 166/217 |
| 4,403,657 | 9/1983 | Adams, Jr. | 166/322 |
| 4,651,818 | 3/1987 | Johnson et al. | 166/115 |
| 4,745,974 | 5/1988 | Higgins | 166/217 |
| 4,760,868 | 8/1988 | Saxon | 138/89 |
| 4,796,698 | 1/1989 | Gano | 166/135 |
| 4,811,959 | 3/1989 | Bullard et al. | 277/124 |
| 4,944,345 | 7/1990 | Mashaw, Jr. | 166/206 |
| 4,997,038 | 3/1991 | Welch | 166/214 |
| 5,000,719 | 3/1991 | Reed | 166/88 |
| 5,133,404 | 7/1992 | Dollison | 166/72 |

*Primary Examiner*—Hoang C. Dang

*Attorney, Agent, or Firm*—William M. Imwalle; Tracy W. Druce

[57] ABSTRACT

A wellhead plug assembly having one or more plugs for plugging segments of a wellhead bore through which access during completion and production procedures is gained. Each plug has a shortened length that is achieved by positioning connections between several of the components of the plug assembly radially beneath the anchoring and sealing means. By placing the connections radially inward to, and in tandem with, the sealing and or anchoring means, the overall length of a given plug may be shortened to less than eleven inches for plugs to be used in conduits having internal diameters greater than one and one-half inch. Furthermore, the tandem orientation allows plug designs in which a majority of the overall longitudinal length of the plug comprises the collective longitudinal lengths of the seal and anchor means.

13 Claims, 4 Drawing Sheets

SHORT WELLHEAD PLUG

FIELD OF THE INVENTION

This invention pertains to plugs for well conduits, and more particularly to plugs employed in access ports of wellheads of subterranean wells.

BACKGROUND OF THE INVENTION

The wellhead and tree are frequently the top most components of subterranean wells. The wellhead can be used to provide several connections and access ports. A typical connection will be to a pipe conduit for transport of produced fluids away from the well. A top entrance port is also generally provided for allowing access into the well from above. The access port will be used for entering the well during completion and production phases of the well, but must be reliably closed when not in use. The wellhead plug provides such a closure when locked in sealing engagement within the access portion of the wellhead. The length of the segment of the wellhead in which the plug is lodged is partially dependent upon the length of the plug itself. The wellhead plugs described herein will typically be used in 37 horizontal" and SPOOLTREE wellheads.

The materials used in the construction of a wellhead are of high-quality and therefore expensive. The high cost is warranted because the wellhead provides a barrier between potentially polluting fluids carried within the well and the environment. The expensive nature of the constituent materials of the wellhead and the fact that a segment of the wellhead is dependent upon the length of the plug precipitates a common goal in wellhead plug design which is minimizing the length of the plug to reduce construction costs of the wellheads. This is particularly true when more than one plug is used within a wellhead for sealing redundancy; in that case, the savings will multiply.

Referring to FIG. 3, a known wellhead plug is illustrated. While it has been desirable to have such wellhead plugs as short as possible, typical embodiments of the illustrated version still have lengths exceeding twelve inches. The shortest known example of the illustrated wellhead plug exceeds eleven inches, regardless of the number and type of sealing means utilized. The difficulty to further decrease the length of the plug is due to construction features embodied therein.

A lengthening feature of the wellhead of FIG. 3 is the arrangement in longitudinal series of several of the wellhead plug's construction characteristics. As an example, the housing/cap thread connection is longitudinally positioned between the seal and anchor means so that the entire length of the thread connection contributes directly to the overall length of the plug assembly. A further detriment of the illustrated configuration stems from the fact that the length of the thread connection increases as the diameter of the plug increases. The increase in thread length is required to provide sufficient structural soundness to the assembly. Greater forces are applied to larger plugs because of the increased area upon which pressures act. If the thread connection is not lengthened, there is a risk that the structural integrity of the plug assembly will falter; that is, the mating threads may strip out and the connection separate. An additional disadvantage of directly increasing the overall length of the plug with elongations of the thread connection is that plugs for different diameter wellheads will have different lengths and lack desired uniformity which increases design time and costs.

In the illustrated configuration of FIG. 3, the length of the plug assembly increases by an amount equal to the distance over which relative motion is required between the expander sleeve and retainer housing. Like the thread connection, this results because the motion limiting connection is in series with the anchor and seal means.

Operational drawbacks may also be encountered in plugs made according to the example of FIG. 3 wherein the expander sleeve is retained within the plug body by a retaining lip positioned at the upper end of a top extension of the key retainer housing. The lip creates a restraining cavity that may become fouled by solid debris that inhibits relative motion between the expander sleeve and the plug body.

In summary, it has been appreciated for some time that a primary goal of wellhead plug design is to shorten the overall length of the plug; in view of known designs, the lower limit has previously exceeded eleven inches.

SUMMARY OF THE INVENTION

Under present circumstances, there can be great return for reducing the length of a wellhead plug to as short as eight inches. As discussed above, this is a goal that previously known designs have not been able to meet. The plug assembly disclosed hereinafter is capable of achieving shortened lengths of about eight inches in several diameter sizes.

A goal of this improved design is to reduce the overall length ($L_T$) of the wellhead plug assembly to as close as possible to the combined length of the anchor means ($L_A$) and the length of the sealing means ($L_S$). This comes from the fact that both the sealing means and anchoring means must be located in series and about the exterior surface of the wellhead plug. This configuration is shown in FIG. 2. For this reason, the seal means and the anchor means have been collectively designated a length extending means because each is located in longitudinal series with the other and must be positioned at the exterior of the plug body for engagement with the wellbore. Therefore, to shorten the plug's length it is necessary to reduce the distances between the keys and seals and to reduce or eliminate structural extensions on either end of the plug beyond those indispensable components. To achieve this, the motion limiting connection between the plug body and the expander sleeve and the housing/cap thread connection have been located out of longitudinal series and into a tandem orientation with the anchor and/or seal means. By tandem it is meant that two or more components are longitudinally coincident, and may be radially offset. In several instances of the present invention, tandem components will be at least partially radially above and below one another. As a result, the combined lengths of the sealing means and anchor means compose a majority of the overall length of the plug assembly. That is, fifty percent or more of the overall longitudinal length of the wellhead plug is attributable to the collective exterior lengths of the sealing and anchoring means. Referring to FIG. 2, this relationship may be seen as:

$$0.5 \times L_T < L_A + L_S$$

Because the housing/cap thread connection is now carried in tandem with the anchor and/or seal means, the connection may be extended for different diameter plugs without effecting the overall length of the plug. This means that plugs having similar longitudinal lengths may be provided for different diameter wellhead bores.

To further shorten the wellhead plug, the expander lock assemblies are shown as being placed between the keys, and substantially tandem thereto. For purposes of this invention, the lock assembly may be completely interiorly positioned to the keys, in the longitudinal direction, so that there is no required extension of the plug to accommodate the lock assembly.

The combined affects of the several shortening features produce appreciably shorter length wellhead plugs than those previously known. Additionally, consistent lengths between different sizes of the wellhead plugs are achievable; that is to say, plugs suitable for closing bores having different internal diameters will have similar lengths. Obviously, this gives great benefit in the larger wellheads where length reduction permits maximum savings.

An additional benefit of eliminating the top end extension and the sliding recess for the expander sleeve is the deletion of the debris receptacle. It has also been contemplated that a sand barrier may be created through the use of o-rings positioned about the interior and exterior diameters of the retainer housing. These o-rings create seals that prevent the introduction of damaging solids into the working mechanisms at the top end of the plug assembly.

Benefits also run from the fact that the instant devices are run into, and retrieved from the wellhead on wireline. This is a more cost effective method of setting and retrieving wellhead plugs than the presently used rod or tubing methods.

Regarding the dual wellhead plug assembly of FIGS. 4 and 5, the primary benefits are the ability to provide redundant sealing capabilities and to longitudinally fix the dual plug assembly within the wellhead bore without any play whatsoever. The absence of play is desired to assist the functionality of the sealing means. In some applications, there may be play between the plug and the landing nipple. This play will allow the plug to move very slightly with respect to the nipple. There are some metal-to-metal (MTM) seals that may be ill-affected by this play, therefore it is desired to prevent the relative motion.

In one preferred embodiment, a wellhead plug assembly is provided that includes a wellhead plug body with a seal means positioned upon an exterior surface of the plug body for sealing engagement with an interior surface of a wellhead bore. There is also an anchor means positioned at the exterior surface of the plug body and adjacent to the seal means which is used for locking the plug body into engagement with the wellhead bore. In this configuration, the seal means and the anchor means are arranged in longitudinal series and therefore their combined longitudinal lengths provide a majority of the wellhead plug's length. These plug assemblies will have lengths less than eleven inches and be appropriate for use in well bores having minimum interior diameters greater than one and one-half inches.

In another embodiment, the wellhead plug assembly includes a plug body having a cap plug that is threadedly connected to a key retainer housing by a housing/cap thread connection. At the exterior of the plug is a seal means for sealing engagement with an interior surface of the wellhead bore and an anchor means positioned adjacent thereto for locking engagement with the wellhead bore. The seal means and anchor means are arranged in longitudinal series. The anchor means has exterior contoured profiles constructed for face-to-face mating engagement with contoured nipples of the wellhead bore. When assembled the housing/cap thread connection is tandemly and radially interiorly positioned to the seal means. An expander sleeve is positioned within the plug body for actuating the anchor means into locking engagement with the wellhead and is connected to the plug body by a motion limiting connection. The motion limiting connection is radially and interiorly positioned to the seal means and the profiles of the anchor means. Also in this configuration, the seal means and the anchor means are arranged in longitudinal series and therefore their combined longitudinal lengths provide a majority of the wellhead plug assembly's longitudinal length. These plug assemblies will have lengths less than eleven inches and be appropriate for use in well bores having minimum interior diameters greater than one and one-half inches.

In yet another embodiment, a wellhead plug assembly including a wellhead plug body having a cap plug threadedly connected to key retainer housing by a housing/cap thread connection is found. The seal means and anchor means are longitudinally arranged and are positioned upon an exterior surface of said plug body for sealing and locking engagement with the wellbore. The anchor means includes lockable keys that are restrained within a key retainer housing and are actuatable by an expander sleeve. The expander sleeve is connected to the wellhead body by a motion limiting connection having a cross pin fixed to the wellhead body and extending into a slot in the expander sleeve for restricted relative motion therein. The seal means and anchor means together make up a length extending means of the plug since each is in longitudinal series, one to the other, and located at the exterior surface of the plug body. The pin of the motion limiting connection and the housing/cap thread connection are each at least partially carried in tandem to the length extending means. Like the others, these plug assemblies will have lengths less than eleven inches and be appropriate for use in well bores having minimum interior diameters greater than one and one-half inches. Still further, there is an expander lock assembly positioned at least partially in tandem with the anchor means so that a majority of the longitudinal length of the lock assembly is longitudinally coincident with the longitudinal length of the anchor means. In this embodiment the seal means includes a non-elastomeric packing stack. It may also, or alternatively, include a MTM seal. The exterior surface of the plug body upon which the seal means are positioned is located on said cap plug. These portions are also referred to as the seal seats.

Regarding the dual plug configuration, there is a bottom wellhead plug and a top wellhead plug positioned in end-to-end abutment. Each wellhead plug has anchor means and may have a seal means positioned at the exterior surface of the plug body. Each anchor means has exterior contoured profiles for face-to-face engagement with contoured nipples in the wellhead bore. The top wellhead plug has an expansion means for radially expanding the anchor means of that plug which results in the application of a compression force between the abutting top and bottom plugs so that downwardly facing profile surfaces of the bottom plug's anchor means abuttingly engage upwardly facing surfaces of a lower contoured nipple while upwardly facing profile surfaces of the top plug's anchor means abuttingly engage downwardly facing surfaces of an upper contoured nipple. This action longitudinally fixes the dual wellhead plug assembly within the wellhead bore and prevents transverse movement of the seal means with respect to the wellhead bore during use. In this embodiment, the expander sleeve has a wedge shaped exterior surface that serves as a ramp beneath the keys of the anchor means for radially actuating those keys. The keys have an inclined interior surface for face-to-face engagement with said wedge shaped expander sleeve. The expander sleeve acts as a locking wedge and is urged toward a locked position by a spring.

DESCRIPTION OF THE PREFERRED EMBODIMENT

Figure 1:
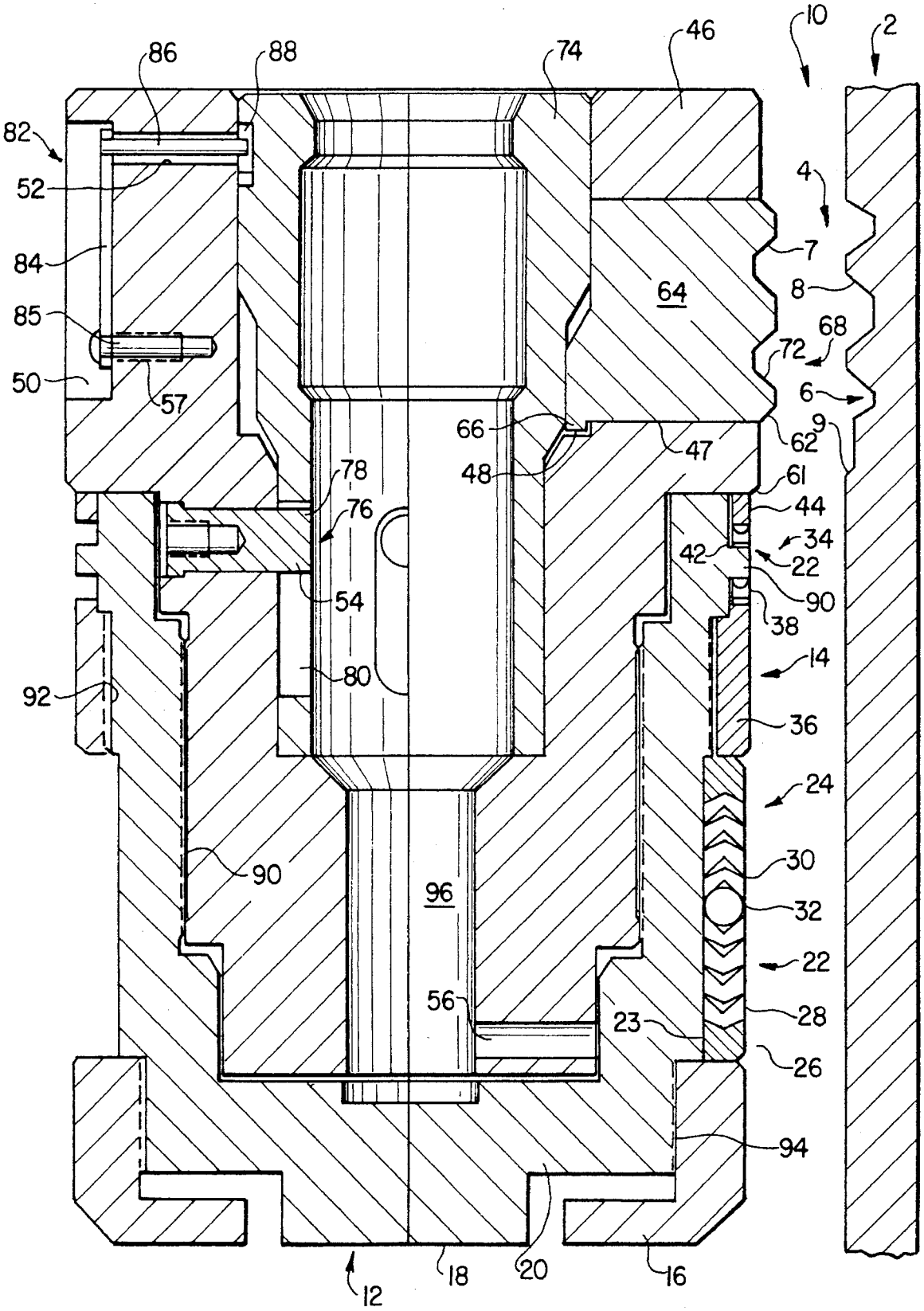
FIG. 1 is a longitudinal cross-sectional drawing of a preferred embodiment of the wellhead plug assembly with the bottom half of the figure taken at a 135 degree radial departure from the top half and showing seal seats for one packing stack and two MTM seals.

Referring to FIG. 1, a preferred embodiment of a wellhead plug assembly 10 is shown. It should be appreciated that many components of the wellhead plug assembly 10 are cylindrical in shape and concentrically oriented. As a result, many share a common longitudinal center line. In many cases throughout the following description, components will be referred to as having longitudinal lengths, as being oriented for relative longitudinal motion, or otherwise be comparatively described as being longitudinally related. In each instance, it should be understood that longitudinal references relate generally to lines parallel to the longitudinal center line of the plug assembly 10.

In typical applications and uses of the wellhead plug assembly 10, the plug 10 will be lowered into a wellhead bore 02 on wire line and when positioned at the appropriate location, locked into contoured nipples 04 for sealing engagement with the bore 02. Each nipple 04 has multiple angled surfaces. Among those surfaces are upwardly facing surfaces 06 and downwardly facing surfaces 08. During use of the plug 10, portions of the plug 10 will abut either the upwardly facing surfaces 06 or the downwardly facing surfaces 08, depending upon the direction of pressure being restrained by the plug 10.

The wellhead plug assembly 10 comprises a wellhead plug body 12 having two primary components; a cap plug 20 and a key retainer housing 46. An exterior surface 14 surrounds the plug body 12. The exterior body surface 14 carries seal means 22 for sealing engagement with the wellhead bore 02. It is contemplated that the seal means 22 may be made up of any appropriate seal which will prevent fluid flow between the wellhead plug assembly 10 and the wellhead bore 02. In the illustrated embodiments of the present invention, the seal means 22 comprises combinations of packing stacks 24 and/or MTM seals 34. The MTM seals 34 may serve as redundant seal means 22 to the packing stack 24 and may be oriented to seal against pressure in one direction. Alternatively, several seal means 22 may be oriented opposingly so that pressure is sealed against in different (both) directions. In actual practice, the well operator will most often be interested in containing pressure from below.

The exterior surface of the plug body may be configured in any way that accommodates the desired seal arrangements. It may be desired that other types of seal means 22 be employed; all that must be included on the plug body is a proper seating receptacle for that seal. This provides versatility. Seal seats 23 upon the exterior surface 14 of the wellhead plug body 12 serve as receivers for the packing stacks 24 and MTM seals 34. The seal seats 23 appear as recesses upon the plug body 12 and restrain the seal means 22 therein.

A conventional packing stack 24 will include in series a metal female adapter ring 26 that is in abutting engagement at a top end with a retainer ring 36 that also supports the bottom of the MTM seal 34. The retainer ring 36 is removably connected to plug body 12 by retainer ring/body thread connection 92. Adjacent to the adapter ring 26 will be a backup ring 28, which is constructed from RYTON in the preferred embodiment. Adjacent to the backup ring 28 is one or more non-elastomeric v-packing rings 30 which are preferably constructed from TEFLON. Adjacent to packing rings 30 is elastomeric o-ring 32 which serves as the center component of the packing stack 24. Below the o-ring 32, a lower half of the packing stack 24 is symmetrical to the upper half; that is, there will next be a series of the packing rings 30, a backup ring 28, and then the metal female adaptor ring 26. The v-shaped packing rings 30 are c-shaped on one side and oppose pressures being applied upon that c-shaped side. Typically, there will be two or more v-packing rings 30 installed together; those in the top half of the stack 24 will be oppositely oriented to the rings 30 of the bottom half. This way, pressures in both directions are contained by the packing stack 24.

Figure 2:
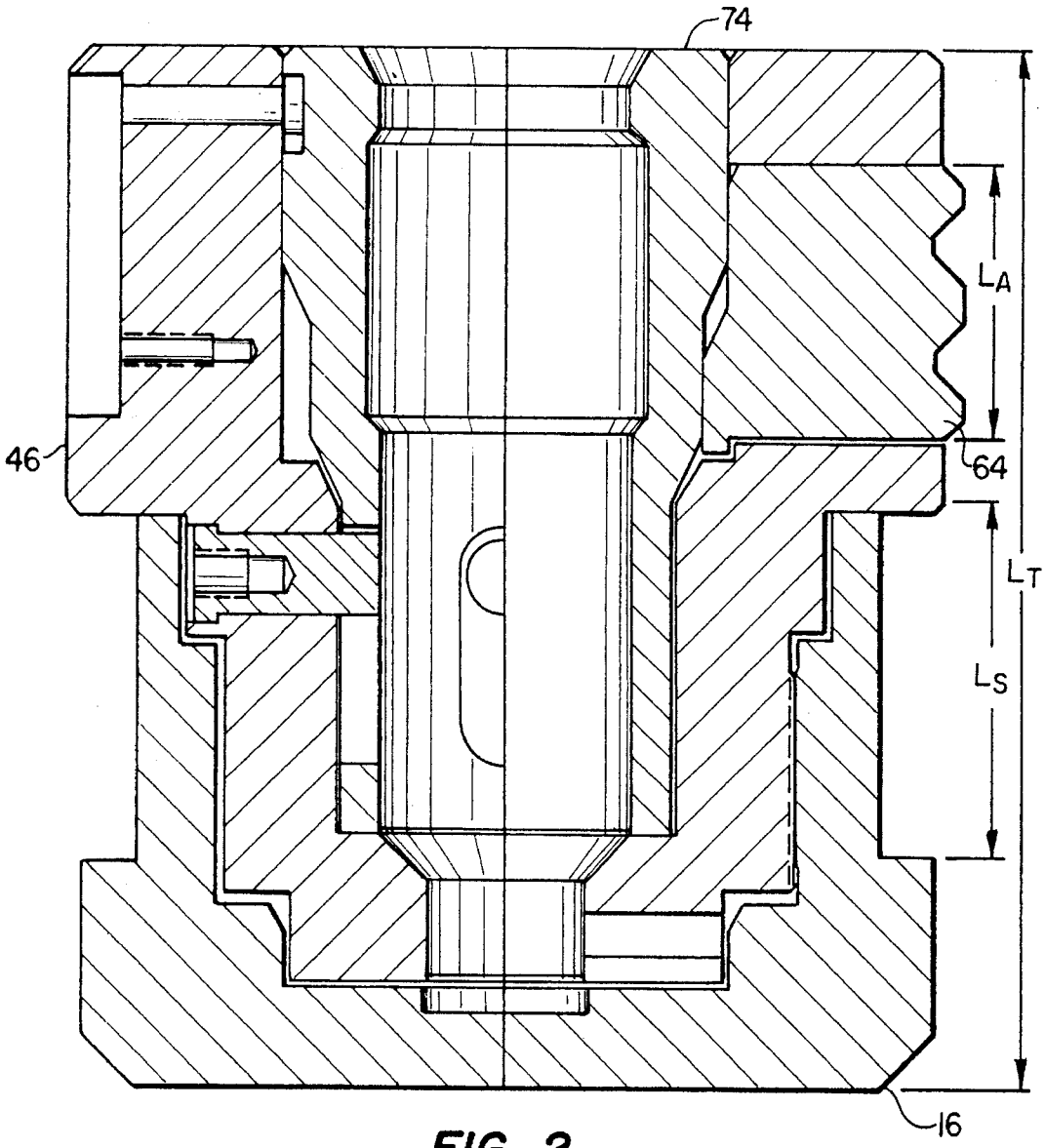
FIG. 2 is a longitudinal cross-sectional drawing of an alternative embodiment of the wellhead plug assembly with the bottom half of the figure taken at a 135 degree radial departure from the top half and showing a seal seat for one packing stack and with the packing nut being an integral part of the cap plug.
Figure 6:
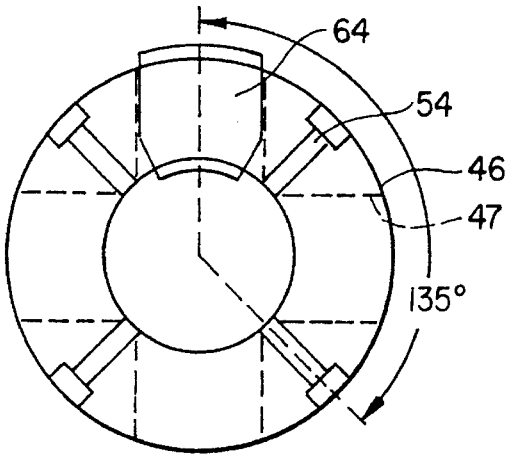
FIG. 6 is cross-sectional view of the key retainer housing showing the lines upon which the half sections of FIGS. 1 and 2 are taken.
Figure 3:
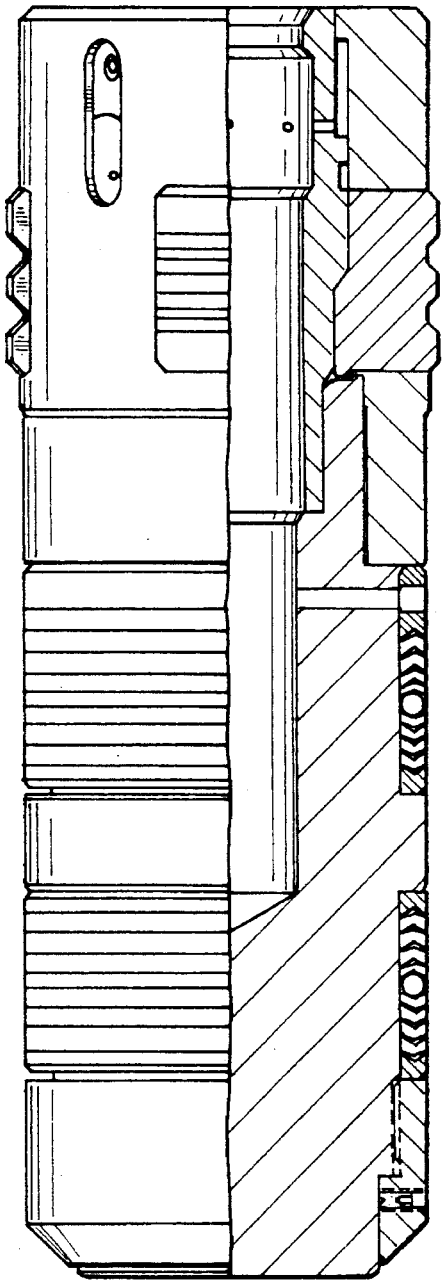
FIG. 3 is a longitudinal partial cross-sectional drawing of a known wellhead plug showing the motion limiting connection and the housing/cap thread connection, among others, in series with the anchor and seal means.

A packing nut 16 is threadedly connected to a bottom end of the cap plug 20 at a packing nut/body thread connection 94. The packing nut 16 secures the packing stack 24 upon plug body 12. In the preferred embodiment, the packing nut 16 is threadedly connected to the body 12 to facilitate installation of the packing stack 24. The cylindrical or ring shaped components of the packing stack 24 will be slid upon the recessed seal seat 23 of the exterior surface 14. It is contemplated, however, that the packing nut 16 could be an integral part of the cap plug 20, as illustrated in FIG. 2, provided means for installing the packing stack 24 upon the plug 10 is provided.

A hexagonal nut head 18 is positioned at the lower most end of the plug body 12 to facilitate assembly and disassembly of the wellhead plug 10. Because many of the connections between the several components of wellhead plug 10 are threaded connections, many relative turns must be completed to assemble and disassemble the plug 10. Furthermore, after the plug is retrieved from a well, the several threaded connections may be tight. By inclusion of the nut head 18, a wrench maybe easily connected to the wellhead plug for rotating the threaded components relative one to the other.

In the preferred embodiment of FIG. 1, the MTM seal 34 is positioned above the packing stack 24. As previously described, the retainer ring 36 abuts a top end of the packing stack 24 and a lower end of the MTM seal 34. Above the retainer ring 36, the MTM seal 34 comprises a bottom MTM c-shaped seal ring 38, a top MTM c-shaped seal ring 42, spacing lip 40 between the bottom and top seal rings 38 and 42, and a spacer ring 44 at a top end of the MTM seal 34. The spacing lip 40 projects from and about the cap plug 20 thereby producing recessed seats 23 for the MTM seal rings 38 and 42. The spacer ring 44 is merely a ring that is positioned between the top seal ring 42 and a lower shoulder of the key retainer housing 46. The purpose of the spacer ring 44 is to longitudinally fix the top seal ring 42 upon the cap plug 20. Referring to the preferred embodiment of FIG. 1, there need only be a minimum length spacer ring 44 between the keys 64 and seal means 22 to prevent interference therebetween. In the accompanying drawings, however, a distance between the plug body and the keys is shown as a middle portion of the key retainer housing. This has been included for machinability, but is not required for the functionality of the plug.

The key retainer housing 46 and the cap plug 20 are connected by housing/cap thread connection 90. As shown, the thread connection 90 is radially interior to the exterior surface 14 of the plug body 12 and substantially beneath the seating areas of the seal seats 23; in other words, partially in tandem therewith.

Anchor means 62 is located near a top end of the wellhead plug assembly. The anchor means 62 is used to lock the plug assembly 10 at a desired location within the wellhead bore 02. In this manner, the plug 10 may be longitudinally fixed with respect to the bore. Keys 64 are retained within an upper portion of the key retainer housing 46. In the preferred embodiment, there is a set of four keys 64, each having a key retainer tab 66 and exterior contoured profiles 68. The contoured profiles 68 are constructed for lockable mating engagement with the contoured nipples 04 of the wellbore 02. Each contoured profile comprises downwardly facing surfaces 70 and upwardly facing surfaces 72. The contoured profiles 68 of the keys 64 are designed to engage the contoured nipples 04 in such a manner upon expansion that the plug 10 is not lifted up off of a no-go shoulder 09 upon which the plug comes to rest at no-go shoulder 61 of the plug 10.

The keys 64 project through key windows 47 that extend through the key retainer housing 46. A key retainer tab recess 48 maybe found at a lower end of the window 47 which receives key retainer tab 66 therein. The purpose of the tab 66 in recess 48 configuration is retention of the keys 64 within the retainer housing 46. Also found at the exterior surface 14 of the key retainer housing 46 is leaf spring recess 50 which provides an indentation into which leaf spring 84 of an expander lock assembly 82 is sunk.

The expander lock assembly 82 comprises the leaf spring 84 which has a lower end fixed to the retainer housing 46 by a securing screw 85 that is anchored in securing screw bore 57. An end of the leaf spring 84 opposite the securing screw 85 is connected to an outer end of lock pin 86. The pin 86 extends through lock pin bore 52 of the retainer housing 46 and is biased radially inward by the spring 84. The expander sleeve 74 has a lock pin recess 88 into which an interior end of the lock pin 86 is received.

The expander sleeve 74 is disposed within the interior of the wellhead body 12 so that an exterior surface of the expander sleeve 74 contacts interior surfaces of the keys 64. The expander sleeve 74 is connected to the plug body 10 by a motion limiting connection 76. The motion limiting connection includes a cross pin 78 that extends within cross pin bore 54 through retainer housing 76 and is stationarily connected thereto. An interior distal end of the cross pin 78 extends into an expander slot 80 of the sleeve 74. The slot 80 has a longitudinal length greater than the diameter of the cross pin 78 and thereby provides means for limited relative longitudinal movement between the expander sleeve 74 and the retainer housing 46.

A hollow within the wellhead plug assembly 10 provides a running tool core hollow 96. The core 96 provides a receptacle for a running tool that is used to run the plug assembly 10 into the wellhead bore 02, set the plug assembly I 0, and eventually retrieve the plug assembly 10, if required. A lower end of the running tool will project into the tool core hollow 96 and be connected therein by a shearable running tool connection pin. The connection pin 98 projects through a running tool pin bore 56 through the key retainer housing 46 and into a receiving bore on the running tool.

Interior sand barrier recess and exterior sand barrier recess are located at the upper end of the key retainer housing 46 for receiving o-rings which seal against debris which may enter into the working mechanisms of the plug assembly 10. Sand barrier comprises an exterior o-ring barrier that creates a seal between the exterior surface 14 of the wellhead plug body 12 and the wellhead bore 02. Interior o-ring barrier is positioned between the retainer housing 46 and the expander sleeve 74. In each case, the o-ring barriers 102 and 104 allow relative motion between the adjacent components while maintaining a seal against debris that may foul the operation of the wellhead plug assembly 10.

Figure 4:
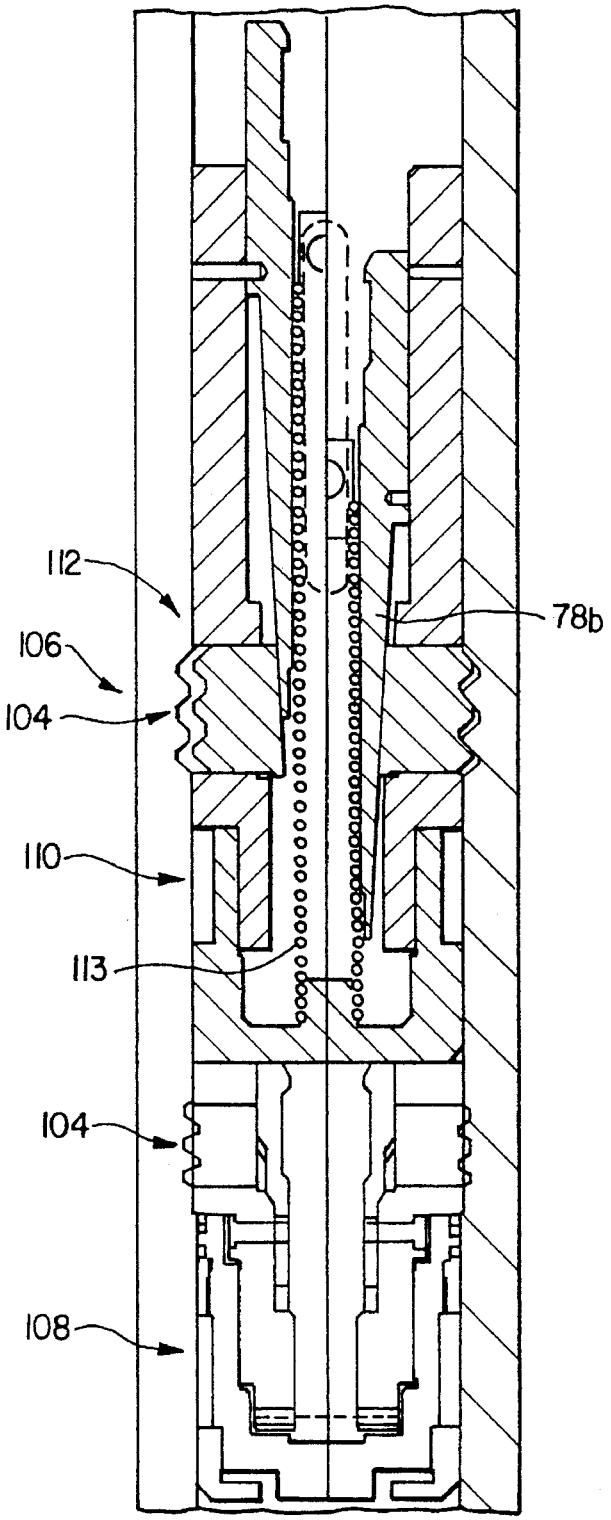
FIG. 4 is a longitudinal cross-sectional drawing of a dual wellhead plug assembly with the bottom half of the figure showing an unset top plug in the wellbore and with the top half showing the top plug set and forcibly pressing against the bottom wellhead plug.

A dual wellhead plug assembly 106 is shown in FIG. 4. In the embodiment depicted therein, a bottom wellhead plug 108 is anchored to a lower contoured nipple 04 below a top wellhead plug 110 which is set in an upper countered nipple 104 above the bottom plug 108. The bottom plug 108 is typical of the wellhead plug assemblies 10 described hereinabove. The top wellhead plug 110, however, differs from the bottom plug 108 in that the expander sleeve **78*b* is wedge shaped for ramped sliding engagement with an interior inclined surface of the key 64. The expander sleeve 78*b* and inclined keys 64 are components of an expansion means 112 that drives the two plugs 108 and 110 toward each other and into abutting engagement. The two plugs 108 and 110 press one against the other with sufficient force to induce an outward compression force at the two lock points between the key 64 and nipples 04 of both the bottom and top plugs 108 and 110**.

The wedge shaped expander sleeve **78*b* acts as a locking wedge because of its low degree of incline or departure from the longitudinal direction. Once the dual wellhead plug assembly is properly engaged, the sleeve 78*b* will not retract on its own because the friction force between the sleeve 78*b* and the inclined interior surface of the key 64 is sufficient to prevent relative movement between the two components. To further assure that the sleeve 78*b* does not back out from under the keys 64, a biasing string 113 is provided which urges the sleeve 78*b*** downward.

It should be appreciated that the primary purpose of the top wellhead plug 110 is to induce the compression force within the dual wellhead plug assembly 106 thereby preventing relative motion between the assembly 106 and the wellhead bore 02. Seal means 22 may, however, be carried on an exterior surface 12 of the top plug 110 and provide a redundant sealing feature in the system. If that is the case, it should be understood that a hydraulic lock may occur between the bottom plug 108 and the top plug 110 as the top plug 110 is being lowered into position. Should this occur, the trapped hydraulic fluid between the two plugs 108 and 110 will prevent further progression of the descending top plug 110. Therefore, an equalization port maybe provided through the cap plug 20 of the top plug 100 to allow the trapped fluid to vent through the core of the top plug 110. For the top plug 100 to act as a fluid barrier, the equalizing ports must then be plugged. A bar stem may then be run down into the core of the top plug 100 after the running tool is removed that plugs the ports.

Figure 5:
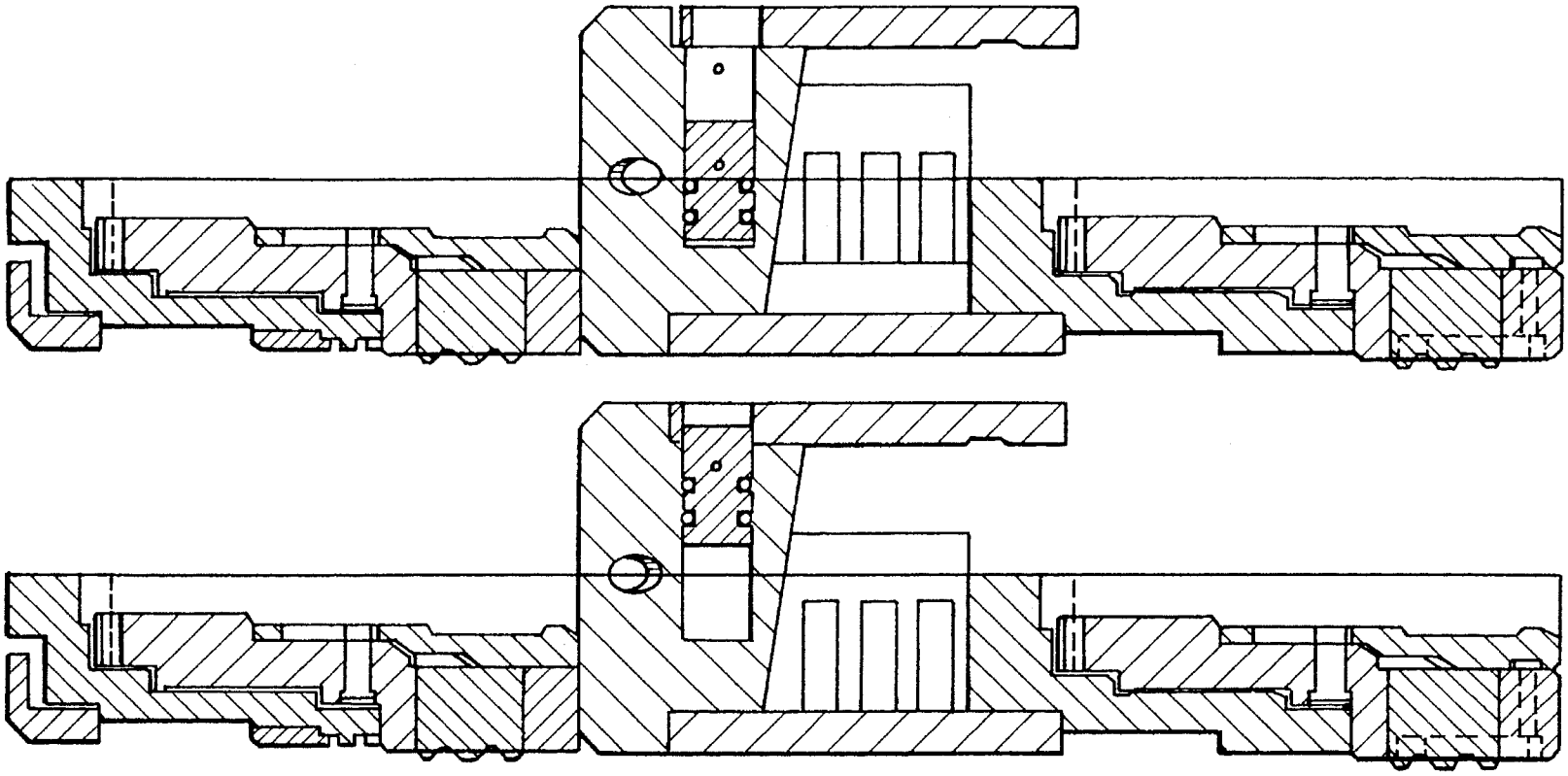
FIG. 5 is two partial longitudinal cross-sectional drawings of a dual wellhead plug assembly showing a pressure actuated piston that initiates elongation of the top plug causing it to forcibly press against the bottom wellhead plug to induce a compression force within the dual assembly.

Referring to FIG. 5, an alternative embodiment of the dual wellhead plug assembly 106 is shown. Once again, the bottom plug 108 is typical of those described herein. The top plug 110, however, has a transversely acting piston that is pumped by fluid pressure from a locked position to an unlocked position. When unlocked, an expansion spring is allowed to activate a transverse wedge which results in an elongation of the top plug 110. By elongating the top plug 110, a compression force is once again created between the anchor means 62 of the bottom and top plugs 108 and 110.

The procedure for assembling the plug assembly 10 as illustrated in FIG. 1 begins with installing the bottom MTM seal ring 38 into a seal seat 23 below and adjacent to the spacing lip 40. The retainer ring 36 is then threadedly connected to the cap plug 20 at the ring/body thread connection 92. The ring 36 is then advanced upon the threads to secure the bottom MTM seal 38 in place. The packing stack 24 is then installed upon the cap plug 20. The components of the stack 24 are ring and cylindrically shaped and are installed in a seal seat 23 created between a bottom side of the retainer ring 36 and a top edge of the packing nut 16 in the following order: a metal female adapter ring 26, a RYTON backup ring 28, two or more of the TEFLON v-packing rings 30, the o-ring 32, two or more of the TEFLON v-packing rings 30, a RYTON backup ring 28, and a metal female adapter ring 26. Typically, the components above the o-ring 32 will face upward to resist pressures from above and the components below the o-ring 32 will face downward to resist pressure from below the plug 10. The packing nut 16 is then threadedly connected to the lower end of the plug body 12 at the nut/body thread connection 94. The nut 16 is then tightened so that it abuts the bottom of the packing stack 24 at a lower edge of a bottom metal female adapter ring 26 for snug engagement therewith. The top MTM c-shaped seal ring 42 is then installed into another seal seat 23 above the spacing lip 40 and the spacer ring 44 is positioned above that to secure the seal ring 42 in place. The upper portion of the plug assembly 10 must then be assembled. Initially, the keys 64 will be placed in the retainer housing 46 with the contoured profiles 68 extending through the key windows 47 to the exterior of the housing 46. The key retainer tab 66 of each key 64 is located in the retainer tab recess 48 of the window 47. The fishnecked sleeve 74 will then be positioned within the interior of the housing 46 so that the keys 64 are prevented from backing out of the windows 47. The running tool will then be inserted into the running tool core hollow 96 of the plug assembly 10 and shearably pinned to the retainer housing 46 by the running tool connection pin 98. The expander sleeve 74 is then connected to the retainer housing 46 by the motion limiting connection 76 during the attachment of housing 46 to the cap plug 20. Attachment of the housing 46 to the cap plug 20 is accomplished by the housing/cap thread connection 90. During the tightening of the parts at the connection 90, however, each cross-pin 78 is installed through a cross pin bore 54 so that a radially interior distal end of the pin 78 extends into the expander slot 80 of the sleeve 74. The position of the pin 78 is fixed by its enlarged head that abuts a recessed shoulder of the bore 54. In this way, the expander sleeve 74 is connected to the housing 46 for relative motion therewith. The housing/cap thread connection is then fully tightened so that the exterior end of the cross pin 78 is covered by a top end of the cap plug 20 and prevented from withdrawing. Upon ultimate tightening of the connection 90, the spacer ring is pushed down into snug abutment with the top MTM seal ring 42.

The process for installing the plug assembly 10 into a wellbore 02 beings with lowering the plug 10 into the well 02 on a running tool to which the plug 10 is pinned. The wellbore 02 includes a radial restriction known as a no-go shoulder 09. There is an engaging radial no-go 61 shoulder on the plug assembly 10. In the illustrated embodiment of FIG. 1, the no-go shoulder 61 is on the retainer housing 46 and constitutes the assembly's 10 largest exterior diameter. When the no-go shoulder 61 of the plug 10 and bore 02 contact, the downward progress of the plug 10 is stopped. The plug assembly 10 is thereby properly positioned to be locked into place. In this configuration, the contoured profiles 68 of the keys 64 are correctly placed adjacent to the contoured nipples 04 of the wellhead bore 02 for locking engagement therewith. Simultaneously, the seal means 22 have progressed into sealing engagement with a polish bore section of the wellhead bore, just below the no-go shoulder 09. The keys 64 are then radially expanded into nipples 04 by pushing the expander sleeve 74 into the plug assembly 10. This is accomplished by hammering or "jarring" through wireline means upon the top end of the sleeve. In this way, ramps upon interior surfaces of the keys 64 ride up on a ramped exterior surface of the advancing sleeve 74. Complete expansion is achieved when a lower end of the sleeve 74 abuts a shoulder of the retainer housing and is prevented from further advancement. At this fully expanded position, the expander lock assembly 82 actuates and prevents the sleeve 74 from withdrawing from within the retainer housing 46. To remove the running tool and leave the plug 10 in place, tension is place on the wireline to assure that the plug 10 is locked into place. The running tool is then "jarred" so that running tool connection pin 98 shears and releases the running tool from the plug assembly 10.

To release the plug assembly 10 and withdraw it from the wellhead bore 02, another tool is lowered into the interior of the expander sleeve 74 and connected to the fishneck which is contained therein. The sleeve 74 may then be "jarred" up, thereby allowing the keys to retract back into the housing 46 and release from the contoured nipples 04. The plug may then be removed from the well on the wireline.

Regarding the dual plug 106 embodiments shown in FIGS. 4 and 5, the top plug 110 will have to have an ultimate outer diameter that is just greater than the ultimate outer diameter of the bottom plug 108. This is because the no-go shoulder 61 of the bottom plug 108 must pass through the top landing nipple 04 before coming to rest upon bottom no-go shoulder 09 in the bore 02. The top plug 110 must then have a diameter sufficient to land upon the no-go shoulder 09 of the top nipple through which the lower plug has passed without impedance.

The first, or bottom plug 108 is run into the wellhead bore 02 and is seated in a nipple 04 so that lower face(s) of the key(s) will abut upper faces of the contoured landing nipple profiles when engaged. A second, or top plug 110 is run into the wellhead above the bottom plug 108 until a bottom end of the top plug 110 abuts a top end of the bottom plug 108. Because of the dimensions of the plug body 12 and key retainer housing 46 of the top plug 110, the keys 64 of the top plug 110 may already be in contact with the top surfaces of the appropriate landing nipple profile. The top plug 110 has a wedged expander sleeve 78*b* and the keys 64 have an interior surface that is angled, or inclined, to mate with the wedged sleeve 78*b*. As the wedged expander 78*b* is driven or "jarred" downward, the keys of the top plug 110 are driven radially outward and longitudinally upward because of the engaging tapered surfaces of the wedge sleeve 78*b* and the keys 64.

The above described configuration places the two plugs 108 and 110 in contact, one to the other, with an outward compression force being applied to the keys 64 upon the respective landing surfaces 04. This compression force assures that the dual plugs 106, as a system, do not move relative to the wellhead 02 and the seal means 22 remain longitudinally stationary during service.

It will be appreciated by those of skill in this particular art that the plug assemblies 10 disclosed herein have specific application in wellhead bores 02, but may be utilized in any well conduits in which the length of the plug 10 is critical and the diameter of the conduit being plugged is greater than one and one-half inches. Moreover, the foregoing detailed description is to be clearly understood as being given by way of illustration and example only, the spirit and scope of the present invention being limited solely by the appended claims.

What is claimed is:

1. A wellhead plug assembly, comprising;

a plug body comprising a cap plug threadedly connected to a key retainer housing by a housing/cap thread connection;

seal means positioned upon an exterior surface of said plug body for sealing engagement with an interior surface of a wellhead bore;

anchor means positioned at said exterior surface of said plug body and adjacent to said seal means for locking engagement with the wellhead bore;

said seal means and said anchor means being arranged in longitudinal series;

said anchor means having exterior contoured profiles for face-to-face mating engagement with contoured nipples of the wellhead bore;

said housing/cap thread connection being tandemly and radially interiorly positioned to said seal means;

an expander sleeve positioned within the plug body for actuating said anchor means into locking engagement with the wellhead;

said expander sleeve connected to said plug body by a motion limiting connection;

said motion limiting connection being radially interiorly positioned to said seal means and said profiles of said anchor means;

a length extending means comprising said seal means and said anchor means, as each are located in longitudinal series, one to the other, and at the exterior surface of the plug body;

said motion limiting connection being tandemly positioned to said length extending means;

said wellhead plug assembly, said seal means, and said anchor means each having a longitudinal length; and said seal mean's and said anchor mean's combined longitudinal lengths providing a majority of said wellhead plug assembly's longitudinal length.

2. The wellhead plug assembly as recited in claim 1, wherein said longitudinal length of said wellhead plug assembly is less than eleven inches.

3. The wellhead plug assembly as recited in claim 1, further comprising:

a wellbore within which said plug body locks and seals having a minimum interior diameter greater than one and one-half inches.

4. The wellhead plug assembly as recited in claim 1, further comprising:

an expander lock assembly at least partially tandemly positioned to said anchor means so that a majority of a longitudinal length of said lock assembly is longitudinally coincident with the longitudinal length of the anchor means.

5. A wellhead plug assembly comprising:

a wellhead plug body;

said wellhead plug body comprising a cap plug threadedly connected to key retainer housing by a housing/cap thread connection;

seal means positioned upon an exterior surface of said plug body for sealing engagement with an interior surface of a wellhead bore;

anchor means positioned at said exterior surface of said plug body and adjacent to said seal means for locking engagement with the wellhead bore;

said seal means and said anchor means being arranged in longitudinal series;

said anchor means comprising lockable keys;

said keys being restrained within a key retainer housing and being actuatable by an expander sleeve;

said expander sleeve connected to said wellhead body by a motion limiting connection;

said motion limiting connection comprising a cross pin fixed to said wellhead body;

said cross pin extending into a slot in said expander sleeve for restricted relative motion therein;

a length extending means comprising said seal means and said anchor means, as each are located in longitudinal series, one to the other, and at the exterior surface of the plug body; and said pin of said motion limiting connection and said housing/cap thread connection each being at least partially tandemly positioned to said length extending means.

6. The wellhead plug assembly as recited in claim 5, further comprising:

an expander lock assembly positioned at least partially in tandem with said anchor means so that a majority of a longitudinal length of said lock assembly is longitudinally coincident with the longitudinal length of the anchor means.

7. The wellhead plug assembly as recited in claim 5, wherein said seal means comprises a non-elastomeric packing stack.

8. The wellhead plug assembly as recited in claim 5, wherein said exterior surface of said plug body upon which said seal means is positioned is located on said cap plug.

9. The wellhead plug assembly as recited in claim 5, wherein a longitudinal length of said wellhead plug assembly is less than eleven inches.

10. The wellhead plug assembly as recited in claim 9, wherein a minimum interior diameter of a wellhead bore into which said wellhead plug assembly locks is greater than one and one-half inches.

11. The wellhead plug assembly as recited in claim 5, wherein said seal means comprises a metal-to-metal seal.

12. The wellhead plug assembly as recited in claim 1, wherein said seal means comprises a non-elastomeric packing stack.

13. A dual wellhead plug assembly, comprising:

a bottom wellhead plug and a top wellhead plug positioned in end-to-end abutment;

each wellhead plug having anchor means positioned at an exterior surface of a plug body for locking engagement with a wellhead bore and a seal means positioned upon said exterior surface of said plug body for sealing engagement with an interior surface of the wellhead bore;

said anchor means having exterior contoured profiles for face-to-face engagement with contoured nipples in the wellhead bore;

said top wellhead plug having an expansion means for radially expanding said anchor means and thereby applying a compression force between said abutting top and bottom plug so that a downwardly facing profile surface of said bottom plug's anchor means abuttingly engages upwardly facing surfaces of a lower contoured nipple and an upwardly facing profile surface of said top plug's anchor means abuttingly engages downwardly facing surfaces of an upper contoured nipple thereby longitudinally fixing said dual wellhead plug assembly within said wellhead bore thereby longitudinally fixing the dual wellhead plug assembly in the wellhead bore so as to prevent transverse movement of said seal means with respect to the wellhead bore during use wherein said expansion means further comprises an expander sleeve restrained within the top wellhead plug;

said expander sleeve having a wedge shaped exterior surface that serves as a ramp beneath a key of the anchor means for radial actuation of said key;

said key having an inclined interior surface for face-to-face engagement with said wedge shaped expander sleeve, wherein said expander sleeve acts as a locking wedge and is urged toward a locked position by a spring.

* * * * *